United States Patent [19]

Mayer et al.

[11] Patent Number: 4,608,872

[45] Date of Patent: Sep. 2, 1986

[54] HAND-OPERATED RATCHET SPANNER FOR TIGHTENING SCREWS

[75] Inventors: Eberhard Mayer, Kirchheim; Oskar Mohilo, Lorch; Jürgen Koltermann, Aalen, all of Fed. Rep. of Germany

[73] Assignees: Dr. Staiger, Mohilo & Co., GmbH; Belzer Dowidat GmbH, both of Fed. Rep. of Germany

[21] Appl. No.: 639,019

[22] Filed: Aug. 9, 1984

[30] Foreign Application Priority Data

Aug. 9, 1983 [DE] Fed. Rep. of Germany ..... 3328673

[51] Int. Cl.[4] ..... B25B 23/142

[52] U.S. Cl. ..... 73/862.23; 81/429

[58] Field of Search ..... 73/761, 862.21, 862.23, 73/862.24; 81/429; 33/125 A; 250/231 SE

[56] References Cited

U.S. PATENT DOCUMENTS 4,211,120 7/1980 Tambini ..... 73/761

4,265,109 5/1981 Hallbauer et al. ..... 73/761 X

FOREIGN PATENT DOCUMENTS 3221658 12/1983 Fed. Rep. of Germany ..... 81/429

0057928 5/1981 Japan ..... 73/761

0049828 3/1982 Japan ..... 73/862.23

*Primary Examiner*—Charles A. Ruehl

*Attorney, Agent, or Firm*—Diller, Ramik & Wight

[57] ABSTRACT

The hand-operated ratchet spanner contains a measuring value pick-up (4,9) for the angle of rotation of the screw and a device for measuring the torque. The measured values are supplied to a microprocessor (22) in which the screw tightening operation is preprogrammed by respective desired or limit values. Signal lamps (30,31,32) or acoustic signal transmitters (33) indicate to the user as to whether the screw has been correctly tightened. Further, he may recognize the extent to which the screw has been tightened and which part of the tightening operation must be still effected.

24 Claims, 4 Drawing Figures

HAND-OPERATED RATCHET SPANNER FOR TIGHTENING SCREWS

Figure 1:
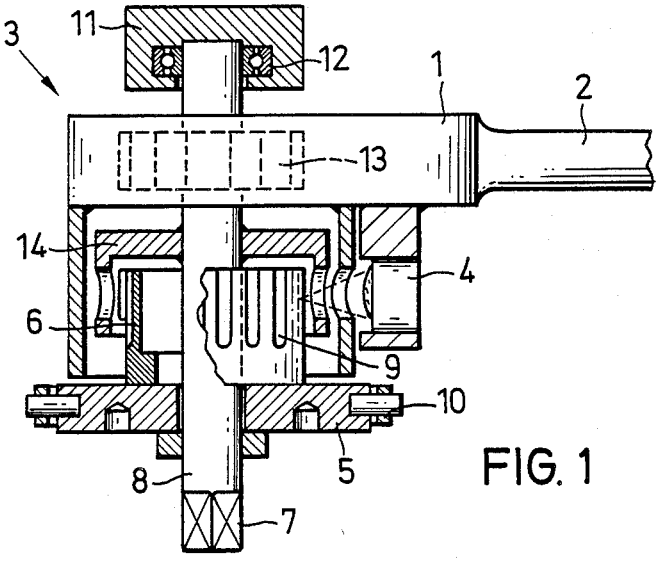

The invention relates to a hand-operated ratchet spanner to tighten screws comprising one measuring value pick-up each for the tightening moment and the angle of rotation as well as evaluation electronics for the controlled tightening of the screw responsive to torque and angle of rotation to initiate, upon reaching the tightening values defined for the respective screw, e.g. the yield strength point, an optical and/or acoustic signal and which is combinable with an angle indicator arm fixable locally.

In view of an electronic hand-operated ratchet spanner of this type, it is the object of the invention to provide a hand-operated spanner which, with a minimum expenditure, allows a continuous measuring and storing of data concerning a screw connection and its objective estimation of quality, by excluding to a far extent the risk of measuring errors and the use of outer cable connections.

A hand-operated ratchet spanner of the inventive configuration allows an evaluation of the screwing data by the microprocessor if the hand operation is discontinuous (repetitive tightening with the ratchet or short breaks during regripping). Further, by the input of desired values and of tolerance limits into the microprocessor, an objective quality evaluation of the screw connection which is indicated to and documented for the user is ensured.

External cable connections being unnecessary due to the battery system of the hand-operated spanner, an unimpeded performance is ensured with the spanner.

Further advantages of the hand-operated ratchet spanner of the invention reside in the fact that angle measuring errors are avoided by the ball-bearing supported scanning head, while, by the use of a reflex probe or photoelectric sensor and of an assigned pulse wheel, relative large axial plays and mounting tolerances are admissible.

The downwardly positioned base of the hand-operated ratchet spanner additionally permits to employ reference points of support in the plane of the screw head thus inhibiting to a far extent angle errors due to lateral tilting movements during screwing. On its assigned indicator and responsive to a code, the incorporated microprocessor displays the missing data to this provide the condition for a safe operation also without operating instructions.

Figure 2:
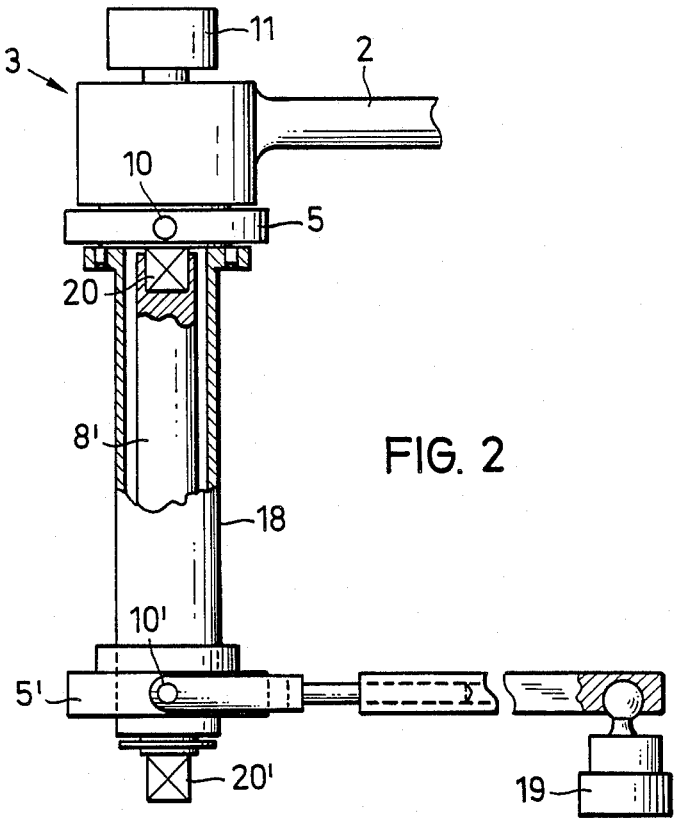
Figure 3:
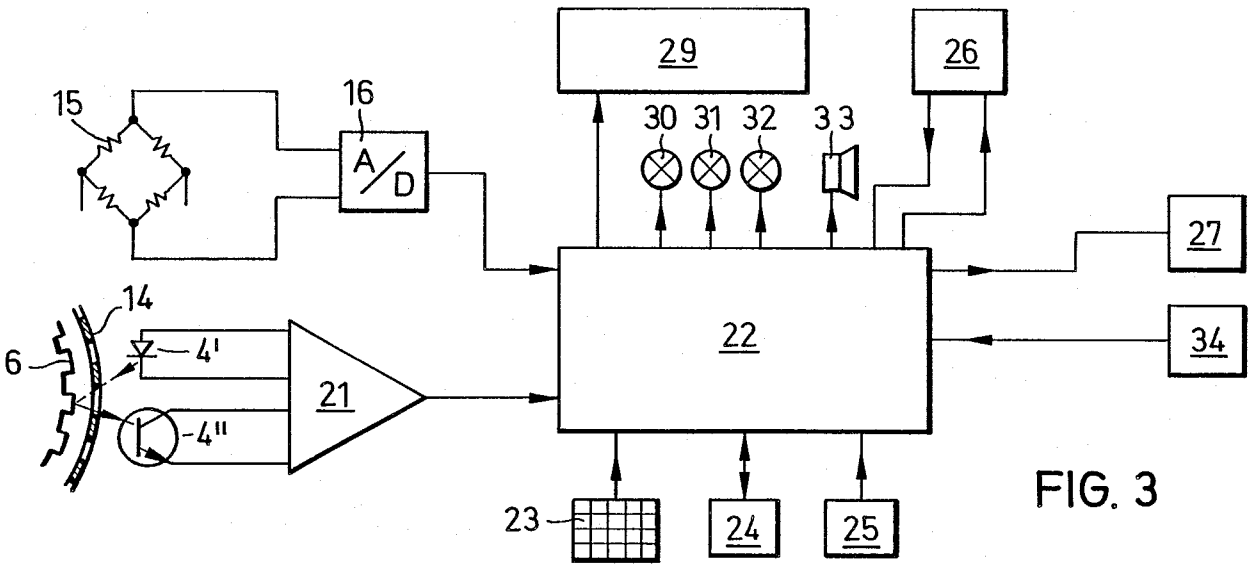
Figure 4:
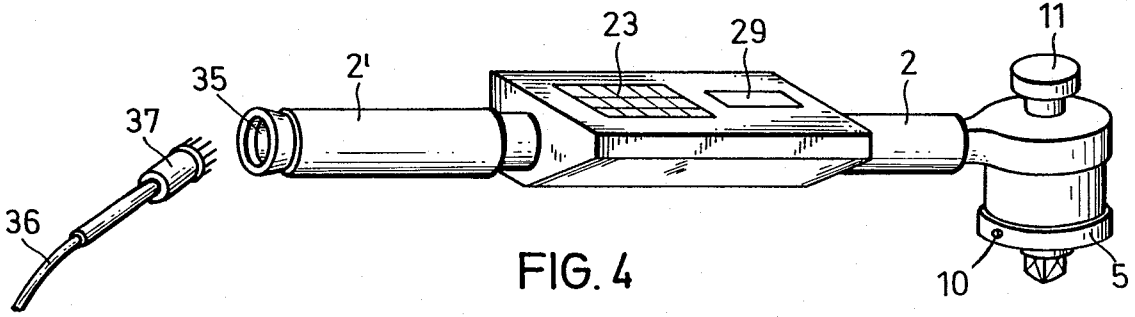

Other advantageous configurations of the invention are evident from the subclaims, from the specification and from the drawing. The invention will be explained in more details with reference to the drawing:

FIG. 1 is a partial section of the head of one exemplary embodiment of the hand-operated ratchet spanner, FIG. 2 shows the base positioned downward by means of a sleeve and comprising an assigned reference point of support adjustable axially for the angle indicator arm, FIG. 3 is a block wiring diagram of the evaluation unit including measured value pick-ups for the tightening torque and the angle of rotation, FIG. 4 is a perspective view of a hand-operated ratchet spanner.

As evident from FIG. 1, the underside of head 1 of the hand-operated ratchet-spanner 3 provided with an actuator 2 comprises a reflex probe photoelectric sensor 4 which, in case of the instant embodiment includes a small semiconductor luminous diode 4' (as a sender) and a phototransistor 4'' as a receiver (see FIG. 3). A pulse wheel 6 is mounted at the base 5 of spanner 3 which base is rotatable relative to the take-off side. The radiation plane of the sensor is coaxial to the longitudinal axis of the driven shaft end 8 of the spanner containing the flat portions 7. Accordingly, the pulse wheel 6 coordinated to the sensor 4 is cylindrical and provided with an axial line graduation 9. Due to such a sensor 4 and pulse wheel 6 mounting, the resultant axial play and the assembly tolerances are relatively large.

Base 5 situated in the same direction as the driven shaft 8 and mechanically joined for inst. by screws, to a forked holder 10 permits to rotate the hand-operated spanner beyond 360° thus allowing tightening operations also in these ranges.

On the end of the driven shaft 8 projecting upwardly beyond the ratchet head 1, a support knob 11 is rotatable by means of a ball bearing 12. Suitably, to ensure a light advance tightening of the screw, the support knob 11 is lockable with the driven shaft 8 by way of known means. To turn the screw as far as to its limit stop at the workpiece, it is possible to rotate the support knob or, if necessary, to also perform a separation, if a continuous run of the screw shall be excluded during "the ratchet action". If the space is restricted, the support knob 11 may be removed or applied to an extension. By the transverse force exerted through the support knob 11 as a reaction to the tractive force at the handle, a central introduction of power is ensured to a far extent so that measuring errors based on additional moments are excluded.

The performance of the angle of rotation measuring means is as follows:

During the tightening of the non-illustrated screw, the ratchet 13 is fixed. Therefore, the angle of rotation of the sensor 4 with the actuator arm 2 of the spanner and of the driven shaft 8 is identical to that of the screw. Base 5 and pulse wheel 6 are immobile. Hence, there is produced a relative movement between the sensor 4 and the pulse wheel 6 with a resultant pulse generation for the angle of rotation measurement. The produced pulses are supplied to a microprocessor via a suitable pulse former. For a better resolution, there is inserted between the sensor 4 and the pulse wheel 6 a slotted shield 14 integrated with the driven shaft 8 and having the same graduation as the pulse wheel 6 to inhibit that the measuring result is affected by a probable resilience of the ratchet. Moreover, with such a slotted shield 14, angle pulses during the retightening operation may be suppressed while the angle of rotation of the driven shaft 8 may be measured directly with reference to the base.

The assembly for measuring the torque consists preferably of a wire strain gauge-bridge 15 which is conventionally carried by the spanner 3, as for example upon the actuator arm 2, and an A/D transducer 16. (see FIG.3).

As illustrated in FIG. 2, the base 5 may be arranged downwardly by means of an adaptor sleeve 18. Thus, also in case of such an extension, the support reference point 19 (permanent magnet) may be provided near the screw and angle errors due to oscillating movements of the operator may be kept at a minimum. The adaptor sleeve 18 is firmly affixed to base 5 transversed coaxially by an extension shaft 8' which is slipped on the square portion 20 and which comprises a square portion 20' at the other end. The adaptor sleeve 18 is provided with a second base 5' engaged by the second forked holder 10' which communicates with the support reference point 19 via a shaft.

As shown by the block diagram of FIG. 3, the light beam emitted by the semiconductur diode 4' for inst. in the form of a Galium-Arsenide-diode gets via the slotted shield 14 to the pulse wheel 6 to be reflected by it according to the line graduation to a receiver 4'' which is for inst. in the form of a phototransistor. Upon a suitable transformation in the pulse former 21 of the light pulses received by the pickup, said pulses get into the microprocessor 22. Accordingly, the torque values determined by means of the wire strain gauge-measuring bridge 15 are supplied to the microprocessor after having been transformed in the A/D transducer 16. The microprocessor is provided with a keyboard 23 adapted to input the respective desired data (desired values, limit values, data about the tightening process etc.) as target values.

Data or adjustments may be entered for a plurality of different screwing cases so as to store them in numbered memories 24 to simply read out said data upon a later demand or reuse.

The final values achieved with a plurality of screwing operations may be stored by adding date and time of their occurrence. To this end, a respective quartz clock 25 is assigned to the microprocessor. At any desired moment, for inst. if all screw connections at a vehicle are effected, the stored values may be read out. Moreover, a data memory 26 is connected to the microprocessor 22. The data including a previously entered code for the operator and the customer number may be read out and displayed in case of demand, for inst. in times when the hand-operated spanner which is not needed, is at rest (shutdown).

The data input may initiate the direct print-out of a control tape or it may be stored in general data processing systems in order to be documented in accompanying papers of the product. Such a printer is designated with 27 in FIG. 3.

To the microprocessor 22 incorporated in the hand spanner there is coordinated an alpha-numeric display 29 showing upon a code supplied by the microprocessor the next missing data. Thus, a safe operation is ensured without operating instruction.

During the tightening of the screw, the user of the spanner is guided in various phases which may be for inst. in the following order:

Phase 1: screw is applied, angle counting starts.
Phase 2: screw is tightened by about 50%.
Phase 3: screw is tightened by about 90%.
Phase 4: screw connection is tight, tightening values are within the tolerance range.
Phase 5: screw is tightened too strongly.

The indication may be realised by displaying a bar of a length that corresponds to the momentaneous tightening phase. As an alternative, specific colored light signals may be coordinated to the individual tightening phases. Thus, phase 1 may be made visible by a lamp 30 emitting a continuous yellow light, while the second phase may be shown by intermittently blinking of the same lamp. To mark the third phase, green light of another lamp 31 is blinking alternatingly with the light of lamp 30 thus producing alternating flashes of yellow and green. The fourth phase is realised by lamp 31 having permanent green light. In case of a screwing failure corresponding to phase 5, it is advisable to use lamp 32 with a permanent red light.

Alternatively or simultaneously, it is possible to display the colored light signals by respective luminous rings at the handle of the spanner in order to allow to easily detect them in all positions and from all sides. In addition or alternatively, the microprocessor 22 may also operate with an acoustic signal generator 33 which allows to detect the individual phases by signals, by different frequencies and/or by different repetiton times of the signal lights.

The boundaries between the tightening phases 1,2 and 3 are not fed, but calculated automatically. This contributes to a simpler handling.

Due to the support surface design of the hand spanner 3, different additional functions are possible when the spanner is put away. It is for inst. possible to recharge via a line extending to a battery charger 34 the batteries incorporated in the spanner. It is also possible to inductively recharge the batteries. Further, the data stored in the microprocessor may be read out or printed so that new data can be fed into the microprocessor or into the memory. There is also the possibility of incorporating the printer 27 as a unit with the battery charger 34 in the tool deposit.

To enlarge the operating field of a hand spanner according to the invention, the actuator 2 or the grip tube may be telescopically extensible. No additional operation is required for yield point controlled tightening processes, because the allowed values are derived by mathematical theory from the fed nominal or limit values for torques and angles.

By suitable programming, processes for the quality appraisal may be used which due to the complicated evaluation mechanisms have not been feasible in practice up to now.

As intimated in FIG. 4, the handle portion 2' of the hand spanner contains a socket 35 into which a plug 37 connected to a feed line 36 may be inserted to charge the batteries housed in the spanner.

What is claimed is:

1. In a hand-operated ratchet spanner for tightening screws, the spanner being of the type which has a spanner head carrying shaft means for rotating a screw, said spanner further including means for determining the torque and means for determining the angle of rotation of a screw which is being tightened by the rotation of said shaft means, electronic means responsive to said torque and angle determining means for initiating an output signal upon reaching a predetermined tightening value, the improvement comprising signal generating and receiving means defining said angle determining means, said signal generating and receiving means including means carried by said spanner head cooperative with a pulse wheel nonrotatably carried by base means for creating output pulses indicative of the rotation of said shaft means, said electronic means being carried by said spanner and including programmable microprocessor means for inputting values corresponding to desired predetermined tightened values of associated screws, handle means for freely rotatably gripping said shaft means at one side of said spanner head, and said base means being located at another side of said spanner head opposite said one side.

2. The improvement in the hand-operated ratchet spanner as defined in claim 1 wherein said signal generating and receiving means is a reflex light barrier having a plane of radiation lying in the axis of rotation of said shaft means.

3. The improvement in the hand-operated ratchet spanner as defined in claim 1 wherein said signal generating and receiving means is a reflex light barrier having a plane of radiation lying in the axis of rotation of said shaft means, said pulse wheel being a cylinder, and said cylinder carrying a plurality of graduations thereon.

4. The improvement in the hand-operated ratchet spanner as defined in claim 1 wherein said signal generating and receiving means is a reflex light barrier having a plane of radiation lying in the axis of rotation of said shaft means, and a slotted cylindrical shield in coaxial exterior surrounding relationship to said pulse wheel.

5. The improvement in the hand-operated ratchet spanner as defined in claim 1 wherein said electronic means further includes means for generating an acoustic output representative of the predetermined tightening value output signal.

6. The improvement in the hand-operated ratchet spanner as defined in claim 1 wherein said electronic means further includes means for generating a visible light output representative of the predetermined tightening value output signal.

7. The improvement in the hand-operated ratchet spanner as defined in claim 6 wherein said visible light generating means are a plurality of color signal generators.

8. The improvement in the hand-operated ratchet spanner as defined in claim 6 wherein said spanner includes a spanner arm connected to said spanner head, said visible light generating means are a plurality of color signal generators, and a plurality of colored rings provided upon said spanner arm corresponding to the color signal generators.

9. The improvement in the hand-operated ratchet spanner as defined in claim 1 including battery means carried by said spanner for generating power for said electronic means.

10. A hand-operated ratchet spanner for tightening screws comprising a spanner head adapted to be rotated relative to a fixed base by a spanner arm, a shaft, ratchet means for rotating said shaft upon rotary motion being imparted to said spanner head by said spanner arm, means carried by said spanner head and base for establishing a predetermined initial spatial position of said spanner head, said predetermined initial spatial positioning means including means carried by one of said spanner head and base for generating and directing a first signal toward the other of said spanner head and base indicative of said predetermined initial spatial position, said predetermined initial spatial positioning means including means carried by the other of said spanner head and base for translating the first signal into at least one further signal indicative of relative arcuate movement of said spanner head away from said predetermined initial spatial position, and said predetermined initial spatial positioning means including means carried by the one of said spanner head and base for sensing said further signal whereby the latter can be utilized to indicate the relative arcuate movement of said spanner head away from said predetermined initial spatial position.

11. The hand-operated ratchet spanner as defined in claim 10 wherein said one of said spanner head and base is said spanner head.

12. The hand-operated ratchet spanner as defined in claim 10 wherein said one of said spanner head and base is said spanner head, and said translating means includes a cylinder in exterior surrounding relationship to said shaft.

13. The hand-operated ratchet spanner as defined in claim 12 wherein said translating means is carried by said base.

14. The hand-operated ratchet spanner as defined in claim 13 wherein said shaft includes driven and drive ends, said driven end is exposed to one side of said spanner head and freely rotatably carries a knob, and said drive end is on a side opposite said one side.

15. The hand-operated ratchet spanner as defined in claim 12 wherein said shaft includes driven and drive ends, said driven end is exposed to one side of said spanner head and freely rotatably carries a knob, and said drive end is on a side opposite said one side.

16. The hand-operated ratchet spanner as defined in claim 15 wherein said shaft projects through an opening of said base, and a support arm connected to said base and carrying magnet means for establishing said predetermined initial spatial position.

17. The hand-operated ratchet spanner as defined in claim 10 wherein said translating means is carried by said base.

18. The hand-operated ratchet spanner as defined in claim 17 wherein said shaft includes driven and drive ends, said driven end is exposed to one side of said spanner head and freely rotatably carries a knob, and said drive end is on a side opposite said one side.

19. The hand-operated ratchet spanner as defined in claim 10 including a second shaft and a second base, means for connecting said second base in axial spaced relationship to said first-mentioned base, means for connecting said first-mentioned and second shaft together, and means for connecting said second base to a fixed support surface.

20. The hand-operated ratchet spanner as defined in claim 10 including microprocessor means carried by said spanner arm for receiving said further signal, and keyboard means carried by said spanner arm for inputing screwing operation data into said microprocessor means.

21. The hand-operated ratchet spanner as defined in claim 10 wherein said first signal generating and directing means is carried by said spanner head, said first signal translating means is carried out by said base, and said sensing means is carried by said spanner head.

22. The hand-operated ratchet spanner as defined in claim 21 wherein said first signal translating means is a pulse wheel.

23. The hand-operated ratchet spanner as defined in claim 21 wherein said first signal translating means is a pulse wheel fixed to said base in external telescopic relationship to said shaft.

24. The hand-operated ratchet spanner as defined in claim 21 wherein said first signal translating means is a pulse wheel, said first signal generating means is a light generator, and said sensing means is a light sensor.

* * * * *